US007152342B2

(12) United States Patent
Sommer

(10) Patent No.: US 7,152,342 B2
(45) Date of Patent: Dec. 26, 2006

(54) REVERSED KINETIC SYSTEM FOR SHOE SOLE

(76) Inventor: Roland Wilfried Sommer, No. 3, 31 Lane, 36 Alley, Long-She Rd., Long-Ching Shiang, Taichung Shien 434 (TW)

( * ) Notice: Subject to any disclaimer, the term of this patent is extended or adjusted under 35 U.S.C. 154(b) by 0 days.

(21) Appl. No.: 10/367,297

(22) Filed: Feb. 14, 2003

(65) Prior Publication Data

US 2004/0159014 A1 Aug. 19, 2004

(51) Int. Cl.
*A43B 13/18* (2006.01)

(52) U.S. Cl. ..... 36/25 R; 36/28; 36/88

(58) Field of Classification Search ..... 36/25 R, 36/28, 35 R, 37, 88, 93
See application file for complete search history.

(56) References Cited

U.S. PATENT DOCUMENTS 4,170,078 A * 10/1979 Moss ..... 36/28
4,502,234 A * 3/1985 Schaefer et al. ..... 36/28
4,658,515 A * 4/1987 Oatman ..... 36/44
4,724,627 A * 2/1988 Sisco ..... 36/117.6
4,970,807 A * 11/1990 Anderie et al. ..... 36/28
5,005,575 A * 4/1991 Geri ..... 602/3
5,086,574 A * 2/1992 Bacchiocchi ..... 36/35 R
5,228,217 A * 7/1993 Dabuzhsky et al. ..... 36/28
5,369,896 A * 12/1994 Frachey et al. ..... 36/29
5,564,202 A * 10/1996 Hoppenstein ..... 36/25 R
6,412,194 B1 * 7/2002 Carlson et al. ..... 36/43
6,546,648 B1 * 4/2003 Dixon ..... 36/25 R
6,562,427 B1 * 5/2003 Hung ..... 428/36.9

FOREIGN PATENT DOCUMENTS

EP 0383685 * 2/1990

* cited by examiner

*Primary Examiner*—Marie Patterson
(74) *Attorney, Agent, or Firm*—Duane Morris LLP

(57) ABSTRACT

A reversed kinetic system for the sole of a shoe includes at least one energy absorber including a plurality of kinetic damping elements for absorbing shock energy and at least one elastically deformable expansion chamber surrounding the at least one energy absorber, wherein the kinetic damping elements are adapted to rub against each other causing friction and absorbing shock energy.

17 Claims, 7 Drawing Sheets

REVERSED KINETIC SYSTEM FOR SHOE SOLE

FIELD OF THE INVENTION

The present invention is directed to a reversed kinetic system for a shoe sole.

BACKGROUND OF THE INVENTION

Shoe soles having gas or gel chambers have been around for many years. These chambers are simple compression springs that suffer from the disadvantage of having no damping effect. Although compression springs are capable of delaying a force transfer, they still return any induced or loaded force without loss. In other words, compression springs have an elastic effect, but are incapable of absorbing energy.

Accordingly, there exists a need for a shoe sole having a damping system capable of absorbing energy.

SUMMARY OF THE INVENTION

The present invention alleviates to a great extent the disadvantages of the known shoe soles by providing a shoe sole having a reversed kinetic system for absorbing shock energy generated during walking, running, jumping, etc. Shoes fitted with such a system provide superb shock absorption as well as excellent contact with the ground, similar to a foot in the sand.

One aspect of the present invention involves a reversed kinetic system for the sole of a shoe, including at least one energy absorber including a plurality of kinetic damping elements for absorbing shock energy, wherein the kinetic damping elements are adapted to rub against each other causing friction and absorbing shock energy.

Another aspect of the present invention involves a reversed kinetic system for the sole of a shoe, including at least one energy absorber including a plurality of kinetic damping elements for absorbing shock energy, wherein the kinetic damping elements are in the form of particles, granulates or globules, wherein the kinetic damping elements comprise solid masses, which act in an inelastic manner under pressure.

A further aspect of the present invention involves a reversed kinetic system for the sole of a shoe, including at least one energy absorber including a plurality of kinetic damping elements for absorbing shock energy, wherein one of the at least one energy absorbers is located in the heel of the sole and another of the at least one energy absorbers is located in a different area of the sole.

An additional aspect of the present invention involves a reversed kinetic system for the sole of a shoe, including at least one energy absorber including a plurality of kinetic damping elements for absorbing shock energy, wherein the at least one energy absorber is spherical, globular, ovular, cubic, polygonal, pyramidal, conical, cylindrical, symmetric or asymmetric, wherein the plurality of damping elements are spherical, globular, ovular, cubic, polygonal, pyramidal, conical, cylindrical, symmetric or asymmetric.

Yet another aspect of the present invention involves a reversed kinetic system for the sole of a shoe, including at least one energy absorber including a plurality of kinetic damping elements for absorbing shock energy and at least one elastically deformable expansion chamber surrounding the at least one energy absorber.

Another aspect of the present invention involves a reversed kinetic system for the sole of a shoe, including at least one energy absorber including a plurality of kinetic damping elements for absorbing shock energy and at least one elastically deformable expansion chamber surrounding the at least one energy absorber, wherein the at least one elastically deformable expansion chamber comprises an airtight plastic casing filled with compressible matter.

A further aspect of the present invention involves a reversed kinetic system for the sole of a shoe, including at least one energy absorber including a plurality of kinetic damping elements for absorbing shock energy and at least one elastically deformable expansion chamber surrounding the at least one energy absorber, wherein the expansion chamber provides both elastic and damping characteristics.

An additional aspect of the present invention involves a reversed kinetic system for the sole of a shoe, including at least one energy absorber including a plurality of kinetic damping elements for absorbing shock energy and at least one elastically deformable expansion chamber surrounding the at least one energy absorber, wherein the expansion chamber includes a plurality of subchambers, wherein at least one of the subchambers contains a plurality of kinetic damping elements, wherein at least one of the subchambers contains a gas or a foam.

Another aspect of the present invention involves a reversed kinetic system for the sole of a shoe, including at least one energy absorber including a plurality of kinetic damping elements for absorbing shock energy and at least one elastically deformable expansion chamber surrounding the at least one energy absorber, wherein the at least one energy absorber includes a top wall and a bottom wall, wherein the top and bottom walls are tapered for improved force distribution under pressure.

These and other features and advantages of the present invention will be appreciated from review of the following detailed description of the invention, along with the accompanying figures in which like reference numerals refer to like parts throughout.

DETAILED DESCRIPTION

In the following paragraphs, the present invention will be described in detail by way of example with reference to the attached drawings. Throughout this description, the preferred embodiment and examples shown should be considered as exemplars, rather than as limitations on the present invention. As used herein, the "present invention" refers to any one of the embodiments of the invention described herein, and any equivalents. Furthermore, reference to various feature(s) of the "present invention" throughout this document does not mean that all claimed embodiments or methods must include the referenced feature(s).

FIGS. 1–12 depict embodiments for a shoe sole having a reversed kinetic system, wherein energy absorption is achieve by the inelastic deformation of at least one energy absorber. In these embodiments, like elements have been numbered accordingly.

Figure 1:
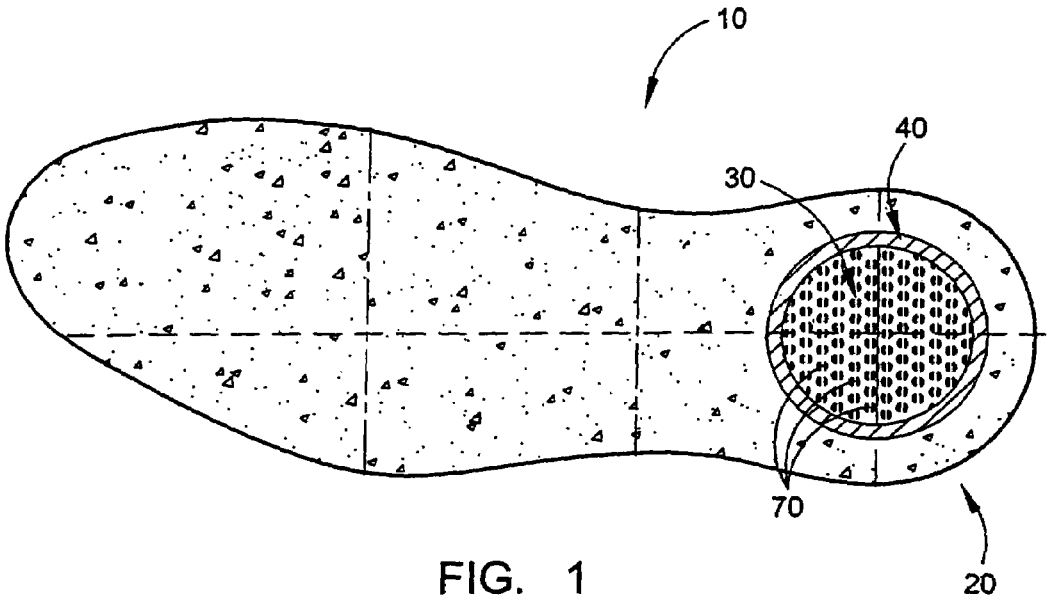
FIG. 1 is a cross-sectional view of an embodiment of an assembly in accordance with the present invention.
Figure 2:
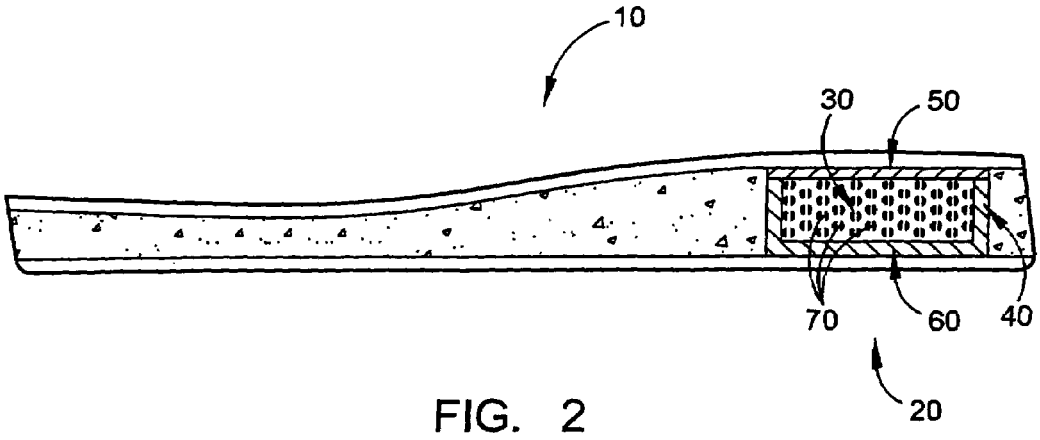
FIG. 2 is a cross-sectional view of an embodiment of an assembly in accordance with the present invention.

As seen in FIGS. 1 and 2, according to some embodiments, shoe sole 10 includes a reversed kinetic system 20 comprising an energy absorber 30, which is surrounded by a spring 40, a top wall 50 and a bottom wall 60. The energy absorber 30 includes a plurality of kinetic damping elements 70 in the form of particles, granules, granulates, globules, micro-granulates or the like. Each time a user takes a step onto the shoe sole 10, the damping elements 70 rub against each other causing friction. Unlike conventional air springs, the kinetic damping elements 70 actually absorb shock energy during use due to friction as they abrade against each other.

The kinetic damping elements 70 comprise solid masses that are structured to act in an inelastic manner under pressure. Instead of acting elastically, the damping elements 70 of the energy absorber 30 rub against each other causing friction and consuming energy. The effect is comparable to a foot stepping in sand, wherein thousands of sand particles abrade against each other, absorbing a substantial amount of the shock energy between the person's foot and the ground when walking. Similarly, according to the present invention, each time a user steps down on the shoe sole 10, energy is absorbed by the inelastic deformation of damping elements 70 against each other. In addition, each time a user steps down, spring 40 surrounding the energy absorber 30 is deformed elastically. After the step, the elastically deformed spring 40 returns itself (and the damping elements 70) to the approximate original configuration. In this manner, a fresh energy absorber 30 is provided for the user's next step. The degree of friction among the damping elements 70 as well as the elasticity of the spring 40 can be controlled by varying the thickness of the spring 40.

Referring to FIGS. 1 and 2, according to some embodiments, there is a single energy absorber 30 containing a plurality of damping elements 70 embedded in the heel portion of sole 10. Although the energy absorber 30 shown in FIGS. 1 and 2 is substantially cylindrical, the energy absorber 30 may be any shape including, but not limited to, spherical, globular, ovular, cubic, polygonal, pyramidal, conical, cylindrical, symmetric and asymmetric. In addition, the cross-section of the energy absorber 30 taken in the plane of the shoe sole 10 may be circular, square, triangular, rectangular or any other shape.

According to some embodiments, the damping elements 70 that comprise The energy absorber 30 are of varying shapes and sizes. According to other embodiments, the damping elements 70 are substantially identical in shape and size. The kinetic damping elements 70 may be any shape including, but not limited to, spherical, globular, ovular, cubic, polygonal, pyramidal, conical, cylindrical, symmetric and asymmetric. Suitable materials for The kinetic damping elements 70 include, but are not limited to, polyamide, rubber, ceramics, aluminum, metal oxide, glass, steel, duroplastics and thermoplastics. Suitable materials for the spring 40 and walls 50,60 include, but are not limited to, rubber, thermoplastic rubber, ethylene vinyl acetate, silicon resin, elastic duromers, solid compound polymers, woven polymers and laminated polymers. As illustrated in the figures, spring 40 is advantageously formed of a material that is different than sole 10. Sole 10 may be formed of various suitable sole materials, including commonly used sole materials. In various exemplary embodiments, the material used for sole 10 will be a different material than the materials used for spring 40 and walls 50, 60. FIG. 2 shows that the generally flat sidewalls that form spring 40 have a height greater than the energy absorber 30.

As seen in FIG. 1, the energy absorber 30 comprises a cylindrical section of the shoe sole 10 corresponding to the location of a user's heel while wearing the shoe. Preferably, the damping elements 70, which make up the energy absorber 30, are strong, resistant to abrasion, silent and light. By varying the number size, material and surface finish of the damping elements 70, the coefficient of friction and, hence, the damping rate, can be controlled.

Figure 3:
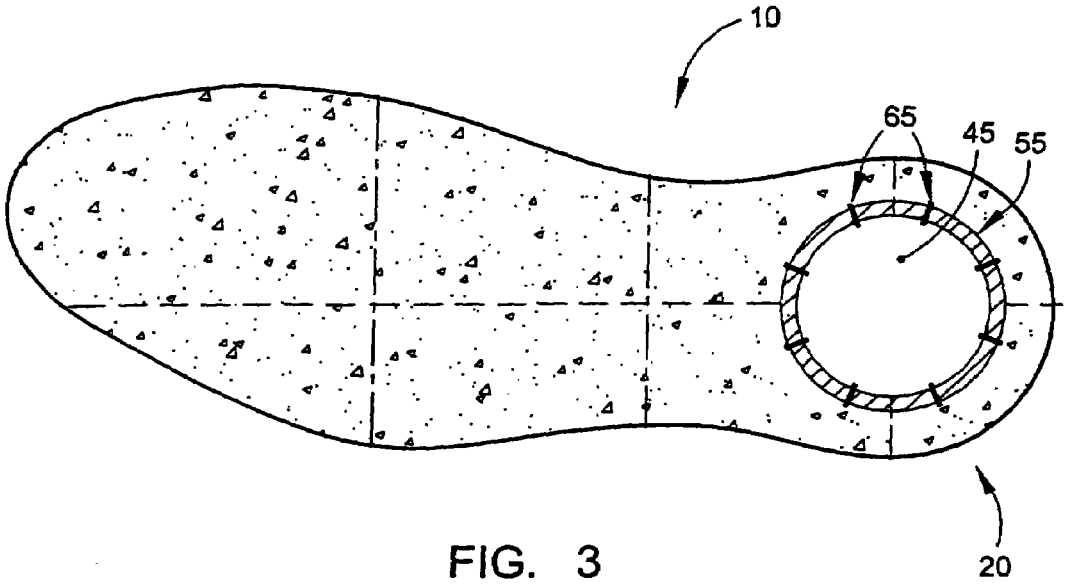
FIG. 3 is a cross-sectional view of an embodiment of an assembly in accordance with the present invention.
Figure 4:
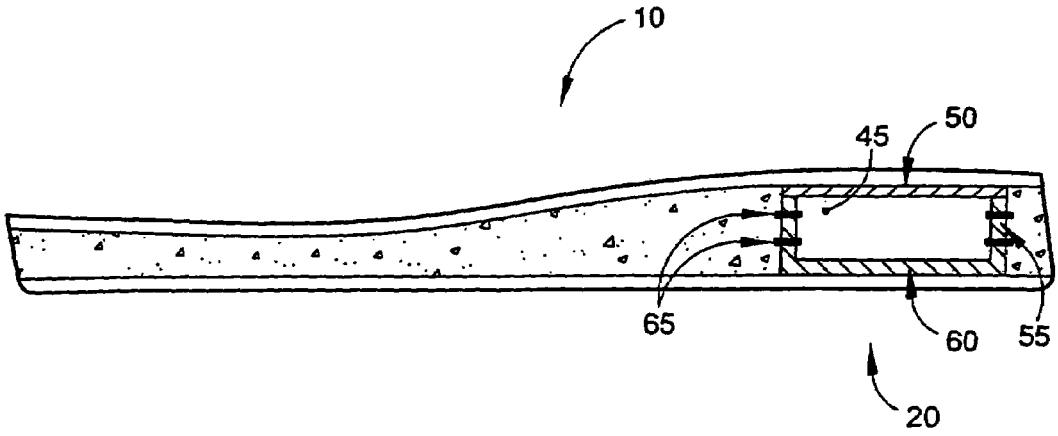
FIG. 4 is a cross-sectional view of an embodiment of an assembly in accordance with the present invention.

As seen in FIGS. 3 and 4 according to some embodiments, shoe sole 15 includes a reversed kinetic system 20 comprising an energy absorber 45, which is surrounded by a spring 55, a top wall 50 and a bottom wall 60, wherein the energy absorber 45 is a gas such as air. At the moment a user takes a step, the gas compresses and is released through at least one bi-directional valve 65 through spring 55. The movement of gas through the at least one valve 65 absorbs energy by producing friction and heat. The spring 55, which deforms elastically when a step is taken, substantially returns to its original configuration after the step, thereby creating a vacuum and causing the spring to refill with gas through the at least one bi-directional valve 65.

Figure 5:
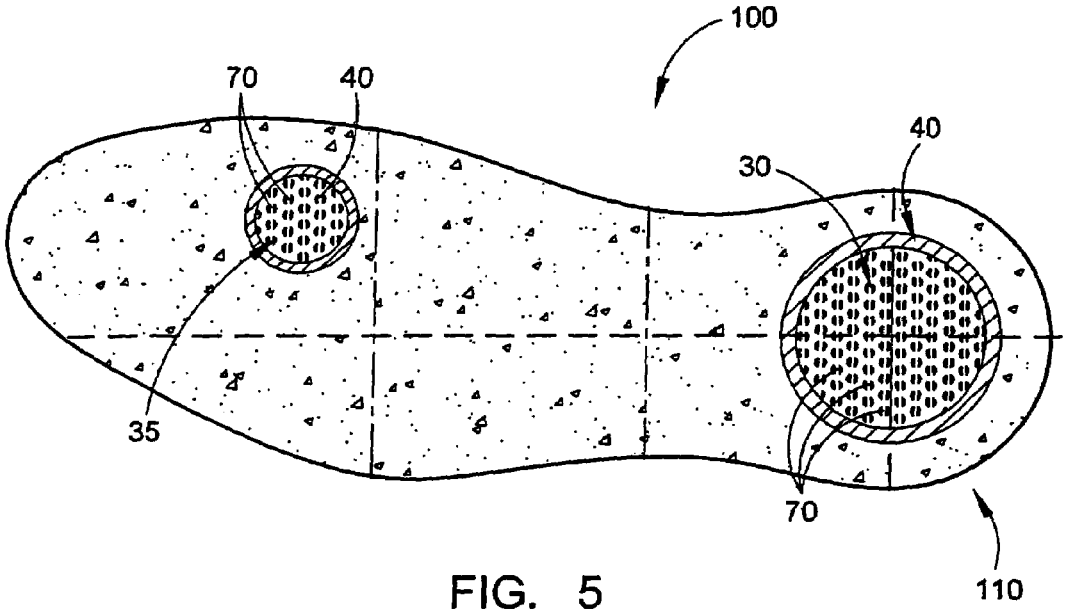
FIG. 5 is a cross-sectional view of an embodiment of an assembly in accordance with the present invention.
Figure 6:
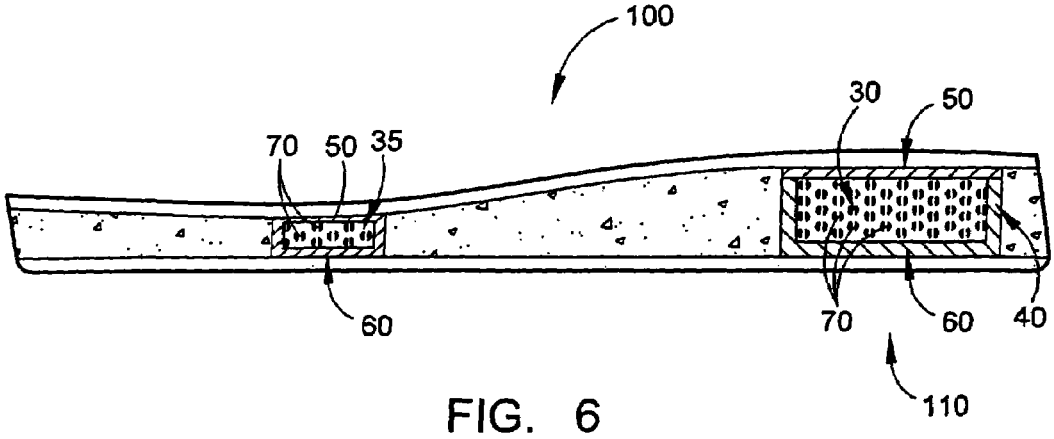
FIG. 6 is a cross-sectional view of an embodiment of an assembly in accordance with the present invention.

As seen in FIGS. 5 and 6, according to other embodiments, shoe sole 100 includes a reverse kinetic system 110 employing a plurality of energy absorbers 30,35, wherein each energy absorber 30,35 comprises a plurality of kinetic damping elements 70 surrounded by a spring 40, top wall 50 and bottom wall 60. Energy absorber 30 is adapted to support the heel of a user. As best seen in FIG. 5, energy absorber 35 is adapted to support another part of the foot of a user corresponding to the ball joint of the big toe. As would be understood by one of ordinary skill in the art, the placement of the energy absorbers 30,35 is not limited to the locations shown in FIGS. 5 and 6. Any number of energy absorbers may be placed at any number of positions within the shoe sole 10 without departing from the scope of the present invention. Preferably, the energy absorbers are placed where the foot experiences the greatest impact forces.

Figure 7:
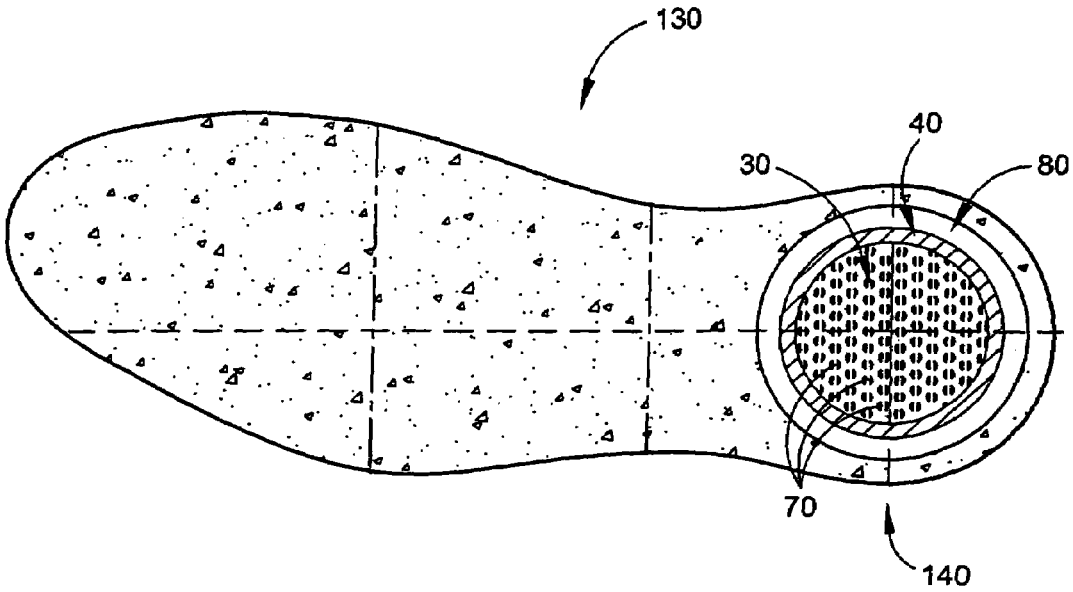
FIG. 7 is a cross-sectional view of an embodiment of an assembly in accordance with the present invention.
Figure 8:
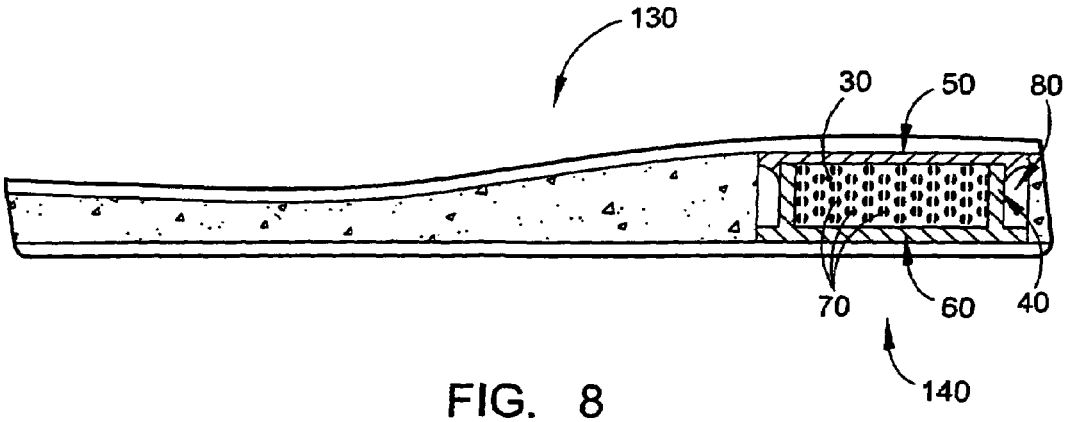
FIG. 8 is a cross-sectional view of an embodiment of an assembly in accordance with the present invention.

As seen in FIGS. 7 and 8, according to some embodiments, shoe sole 130 includes a reverse kinetic system 140 including both elastic and damping characteristics. The system 140 comprises an energy absorber 30 surrounded by a spring 40, a top wall 50 and a bottom wall 60. The system 140 further includes at least one elastically deformable expansion chamber 80 comprising an airtight plastic casing filled with compressible matter such as gas. The expansion chamber 80 surrounds the spring 40. Although the energy absorber 30 and expansion chamber 80 are depicted as substantially cylindrical, is should be appreciated by those skilled in the art that the energy absorber 30 and expansion chamber 80 may be other shapes such as spherical, globular, ovular, cubic, polygonal, pyramidal, conical, cylindrical, symmetric or asymmetric, without departing from the scope of the present invention. A suitable material for the plastic casing of the expansion chamber 80 is polyurethane or other materials with similar characteristics.

Referring to FIGS. 7 and 8, each time the user steps down on the sole 130 with a foot, energy is absorbed by the kinetic damping elements 70 and the material within expansion chamber 80 is compressed. As the user lifts his foot, the expansion chamber 80 decompresses returning itself and the energy absorber 30 to the original configuration and providing refreshed kinetic system 140 for the user's next step. The decompression of elastic expansion chamber 80 also transmits a substantial amount of energy and upward thrust to the user's heel as the foot is lifted. Thus, a shoe sole 130 comprising a reverse kinetic system 140 including both elastic and damping characteristics is provided.

Figure 9:
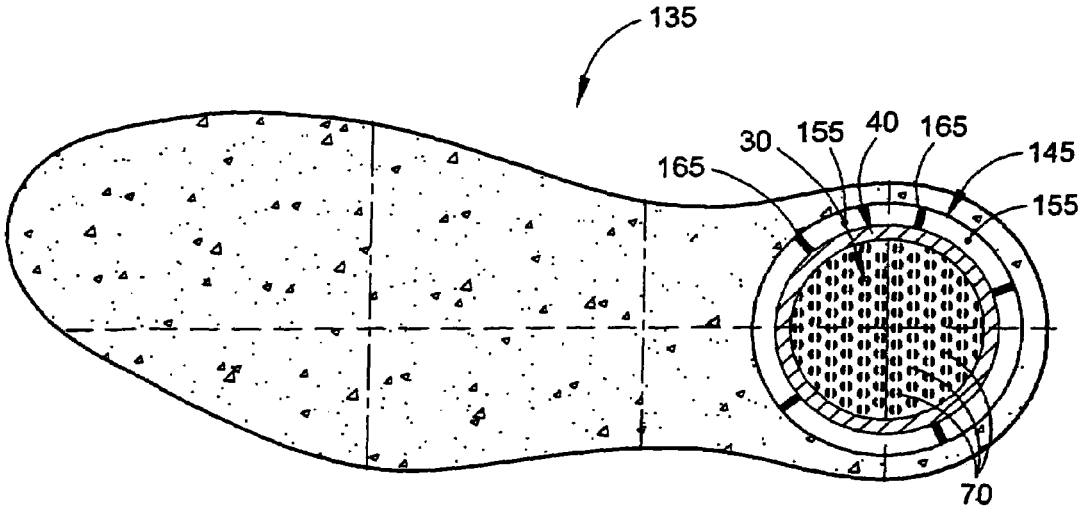
FIG. 9 is a cross-sectional view of an embodiment of an assembly in accordance with the present invention.
Figure 10:
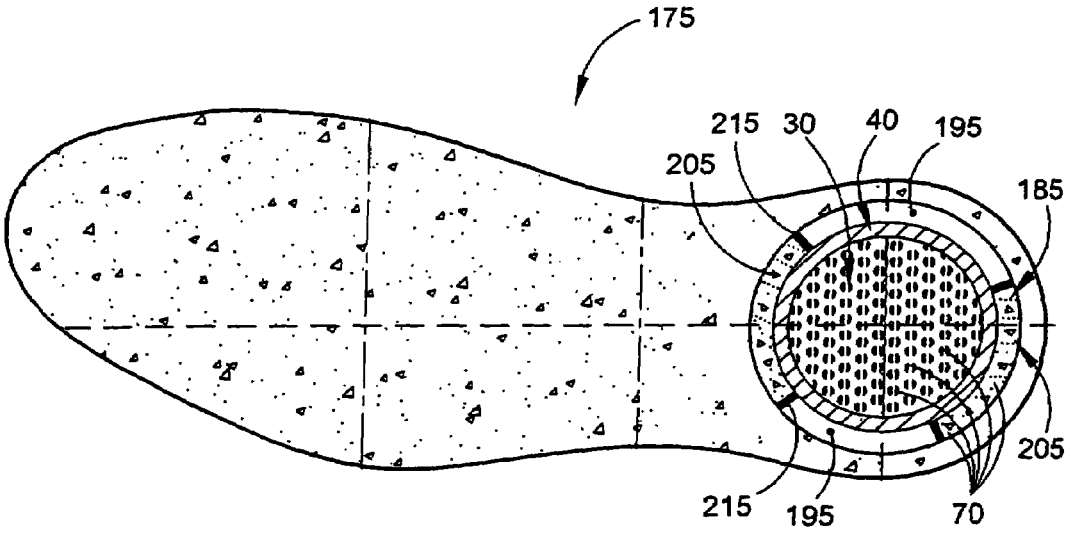
FIG. 10 is a cross-sectional view of an embodiment of an assembly in accordance with the present invention.

As seen in FIGS. 7 and 8, according to some embodiments, the expansion chamber 80 consists of a single chamber surrounding the energy absorber 30. However, as seen in FIGS. 9 and 10, according to other embodiments, the expansion chamber 85 consists of a plurality of subchambers 95. A plurality of partition walls 105 separate the expansion chamber 85 into the subchambers 95.

As seen in FIG. 9, a shoe sole 135 includes an expansion chamber 145 comprising a plurality of subchambers 155 separated by partition walls 165 and containing compressible matter such as a gas, gel or foam. The pressure within some subchambers 155 and the elasticity of some partition walls 165 may be varied to achieve a shoe sole 135 having diverse elastic characteristics.

As seen in FIG. 10, shoe sole 175 includes an expansion chamber 185 comprising a plurality of subchambers 195,205 separated by partition walls 215 and containing compressible matter such as gas or foam in some subchambers 195 and kinetic damping elements 70 in other subchambers 205. In this embodiment, the expansion chamber 185 provides both a damping effect and an elastic effect during use of the shoe.

Figure 11:
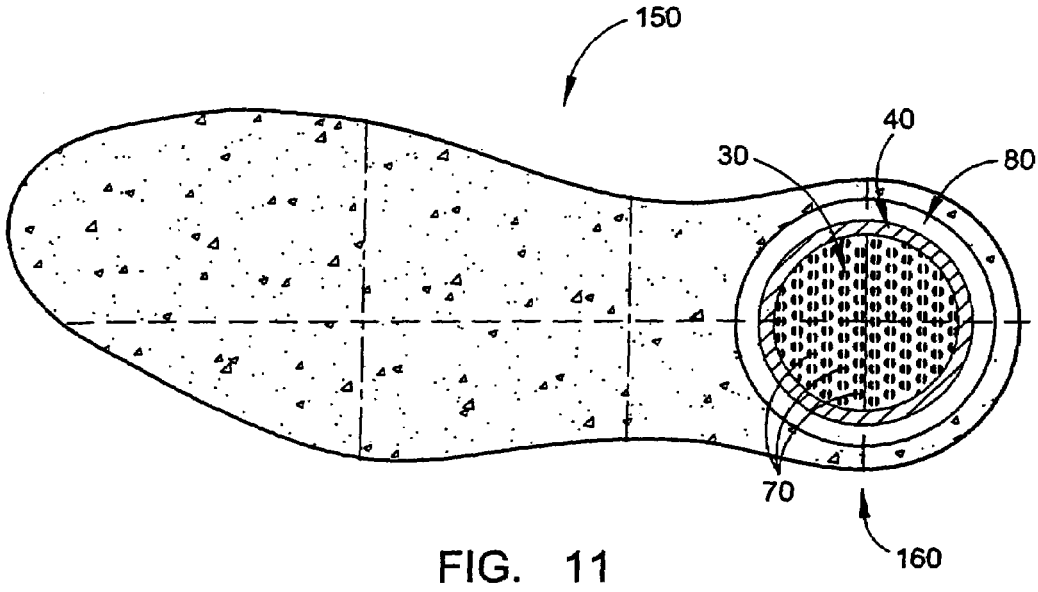
FIG. 11 is a cross-sectional view of an embodiment of an assembly in accordance with the present invention.
Figure 12:
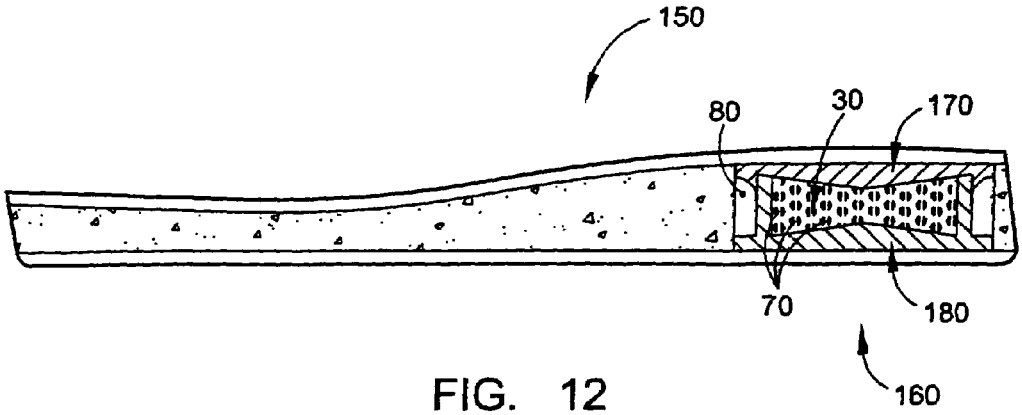
FIG. 12 is a cross-sectional view of an embodiment of an assembly in accordance with the present invention.

As seen in FIGS. 11 and 12 according to other embodiments, shoe sole 150 includes a reverse kinetic system 160 comprising an energy absorber 30 surrounded by a spring 40, a top wall 170, a bottom wall 180 and an expansion chamber 80. As seen in FIG. 10, the top and bottom walls 170,180 are tapered such that they are thicker towards the center of the energy absorber 30. The varied thickness of the top and bottom walls 170,180 helps distribute the forces substantially evenly as pressure is applied to energy absorber 30.

Figure 13:
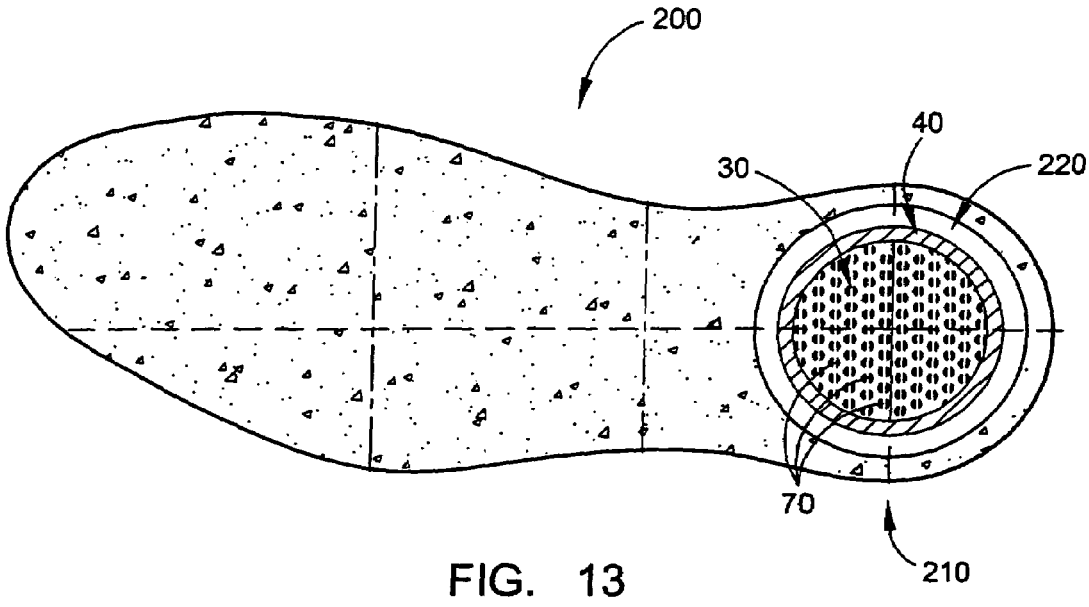
FIG. 13 is a cross-sectional view of an embodiment of an assembly in accordance with the present invention.
Figure 14:
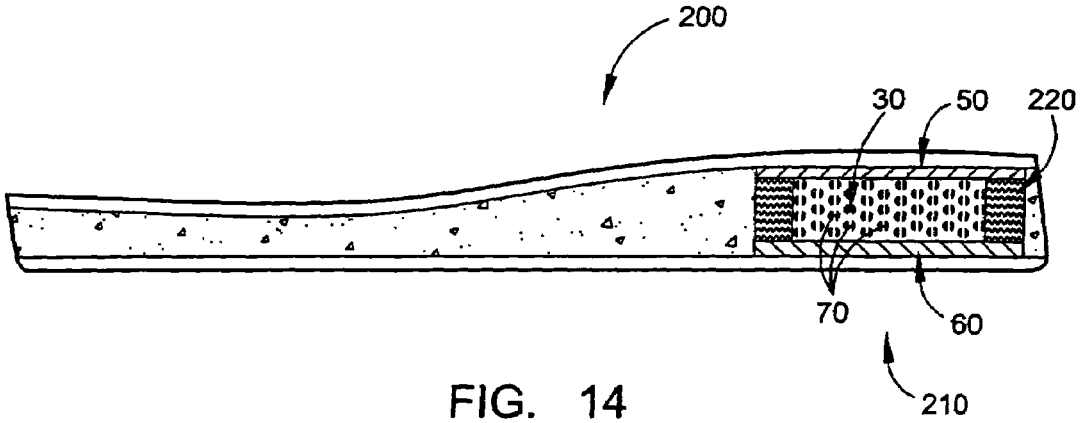
FIG. 14 is a cross-sectional view of an embodiment of an assembly in accordance with the present invention.

As seen in FIGS. 13 and 14, according to further embodiments, a shoe sole 200 includes a reverse kinetic system 210 comprising an energy absorber 30 surrounded by a top wall 50 and a bottom wall 60. The system 210 further includes at least one expansion chamber 220 comprising an airtight plastic casing filled with an elastic foam. According to some embodiments, the expansion chamber 220 is a cylindrical chamber surrounding a cylindrical energy absorber 30. Depending upon the shape of the energy absorber 30, the expansion chamber 220 may be other shapes such as spherical, globular, ovular, cubic, polygonal, pyramidal, conical, cylindrical, symmetric or asymmetric.

Thus, it is seen that a reversed kinetic system for a shoe sole is provided. One skilled in the art will appreciate that the present invention can be practiced by other than the various embodiments and preferred embodiments, which are presented in this description for purposes of illustration and not of limitation, and the present invention is limited only by the claims that follow. It is noted that equivalents for the particular embodiments discussed in this description may practice the invention as well.

What is claimed is:

1. A reversed kinetic system for the sole of a shoe, comprising:

at least one energy absorber disposed within a shoe sole formed of sole material, the energy absorber including a plurality of kinetic damping elements for absorbing shock energy and laterally surrounded by sidewalls formed of a spring material different than the sole material, the sidewalls having a straight surface in one direction, forming a spring and being laterally surrounded by the sole material, wherein the kinetic damping elements are inelastic elements.

2. The reversed kinetic system of claim 1, wherein the inelastic elements are positioned such that they rub against each other causing friction and absorbing shock energy when pressure is applied to the sole.

3. The reversed kinetic system of claim 1, wherein the kinetic damping elements are in the form of particles, granulates or globules.

4. The reversed kinetic system of claim 1, wherein the kinetic damping elements comprise solid masses, which act in an inelastic manner under pressure.

5. The reversed kinetic system of claim 1, wherein the at least one energy absorber is located in the heel area of the sole.

6. The reversed kinetic system of claim 1, wherein one of the at least one energy absorbers is located in the heel area of the sole and another of the at least one energy absorbers is located in a different area of the sole.

7. The reversed kinetic system of claim 1, wherein the at least one energy absorber is substantially cylindrical.

8. The reversed kinetic system of claim 1, wherein the at least one energy absorber is spherical, globular, ovular, cubic, polygonal, pyramidal, conical, cylindrical, symmetric or asymmetric.

9. The reversed kinetic system of claim 1, wherein the plurality of damping elements are spherical, globular, ovular, cubic, polygonal, pyramidal, corneal, cylindrical, symmetric or asymmetric.

10. The reversed kinetic system of claim 1, wherein the at least one energy absorber is disposed between a top wall and a bottom wall formed within the sole of the shoe.

11. The reversed kinetic system of claim 1, wherein the spring is adapted to return itself and the energy absorber to their approximate original configuration.

12. The reversed kinetic system as in claim 1, wherein the sidewalls are generally orthogonal to a bottom of the sole.

13. A reversed kinetic system for the sole of a shoe, comprising:

at least one energy absorber including a plurality of kinetic damping elements for absorbing shock energy, the energy absorber having a first height and laterally surrounded by a spring having a second height greater than the first height and sidewalls having a straight surface in one direction and including a portion that extends above an uppermost portion of the energy absorber and is external to an outermost horizontal peripheral edge of the energy absorber, the kinetic damping elements being inelastic in nature.

14. The reversed kinetic system as in claim 13, wherein the sidewalls are generally orthogonal to a bottom of the sole.

15. The reversed kinetic system as in claim 13, wherein the energy absorber and spring are disposed within the sole.

16. The reversed kinetic system as in claim 15, wherein the sole is formed of sole material; and the spring is formed of spring material being different than the sole material and is laterally surrounded by the sole material.

17. The reverse kinetic system as in claim 13, wherein the damping elements are particles, granulates or globules positioned such that they rub against each other causing friction and absorbing shock energy when pressure is applied to the sole.

* * * * *